United States Patent [19]

Young

[11] 4,240,740

[45] Dec. 23, 1980

[54] DEVELOPMENT SYSTEM

[75] Inventor: Eugene F. Young, Henrietta, N.Y.

[73] Assignee: Xerox Corporation, Stamford, Conn.

[21] Appl. No.: 47,615

[22] Filed: Jun. 11, 1979

[51] Int. Cl.[3] ..... G03G 15/00

[52] U.S. Cl. ..... 355/3 DD; 118/657

[58] Field of Search ..... 355/3 DD; 118/657, 658; 430/122

[56] References Cited

U.S. PATENT DOCUMENTS

| | | | |
|---|---|---|---|
| 3,614,221 | 10/1971 | Solarek | 355/3 DD |
| 3,664,857 | 5/1972 | Miller | 118/656 X |

FOREIGN PATENT DOCUMENTS

| | | | |
|---|---|---|---|
| 53-67438 | 6/1978 | Japan | 355/3 DD |

OTHER PUBLICATIONS

*IBM Tech. Disc. Bull.*, R. G. Cross, vol. 8, No. 12, May 1966, p. 1730.

*Primary Examiner*—R. L. Moses

*Attorney, Agent, or Firm*—H. M. Brownrout; C. A. Green; H. Fleischer

[57] ABSTRACT

An apparatus which develops a latent image with magnetic particles. The apparatus includes a member having a multiplicity of magnetic fibers extending outwardly therefrom. At least a portion of the fibers have the free end regions thereof contacting the latent image. A magnet field attracts the particles to the member. Relative movement between the member and magnet field move the particles into contact with the latent image to form a substantially uniform particle image.

22 Claims, 3 Drawing Figures

DEVELOPMENT SYSTEM

This invention relates generally to an apparatus for developing a latent image with magnetic particles. An apparatus of this type is frequently employed in an electrophotographic printing machine.

Generally, an electrophotographic printing machine includes a photoconductive member which is charged to a substantially uniform potential to sensitize its surface. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mix into contact therewith. This forms a powder image on the photoconductive member which is subsequently transferred to a copy sheet. Finally, the copy sheet is heated to permanently affix the powder image thereto in image configuration.

Frequently, the developer mix comprises toner particles adhering triboelectrically to carrier granules. This two component mixture is brought into contact with the latent image. The toner particles are attracted from the carrier granules to the latent image forming the powder image thereof.

With the advent of single component developer materials, carrier granules are no longer required. In general, the developer material particles have low resistivities, e.g. the resistivity ranges from about $10^7$ to about $10^{16}$ ohm-centimeters. During development, these particles are deposited on the latent image. Though development is optimized by employing particles having low resistivity or good conductivity, transfer is optimized by employing particles having high resistivities. Thus, the printing machine is faced with two contradictory requirements, i.e. the utilization of particles having low resistivity for optimum development and the requirement of high resistivity to achieve optimum transfer. It has been found that when more resistive particles are employed, they frequently produce images having portions of the solid areas deleted. Various approaches have been devised to improve development.

The following disclosures appear to be relevant:

IBM Technical Disclosure Bulletin
Volume 8, Number 12, Page 1732
Author: Cross
Published: May, 1966

U.S. Pat. No. 3,614,221
Patentee: Solarck
Issued: Oct. 19, 1971

U.S. Pat. No. 3,664,857
Patentee: Miller
Issued: May 23, 1972

Japanese Patent Laid Open No: 53-67438
Laid Open Date: June 15, 1978
Japanese Patent Application No: 51-142260
Application Date: Nov. 29, 1976

The pertinent portions of the foregoing disclosures may be briefly summarized as follows:

Cross discloses a rotatable non-magnetic cylinder having helical iron spirals mounted thereon. The cylinder rotates in a container having magnets mounted externally thereof.

Solarck describes a woven pile brush having non-conductive and conductive pile fibers. The conductive pile fibers are shorter than the non-conductive fibers and can function as a development electrode while avoiding contact with the latent image.

Miller discloses a pair of metalized fur brushes having individual flexible filaments coated with a thin layer of an electrically conductive metal. One brush has low electrical conductivity, the other high electrical conductivity.

The Japanese patent application discloses a permanent magnet disposed inside of a rotatable cylindrical non-magnetic sleeve. A fiber brush whose volume electrical resistance ranges from about $10^6$ to about $10^{14}$ ohm-centimeters and whose height ranges from about 0.5 to about 10 millimeters is secured to the outer periphery of the non-magnetic sleeve.

In accordance with the present invention, there is provided an apparatus for developing a latent image. The apparatus includes a member having a multiplicity of magnetic fibers extending outwardly therefrom. At least a portion of the fibers have the free end region thereof contacting the latent image. Means are provided for generating a magnetic field to attract the particles to the member. Means produce relative movement between the member and magnetic field to move the particles into contact with the latent image to form a substantially uniform particle image.

Other features of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
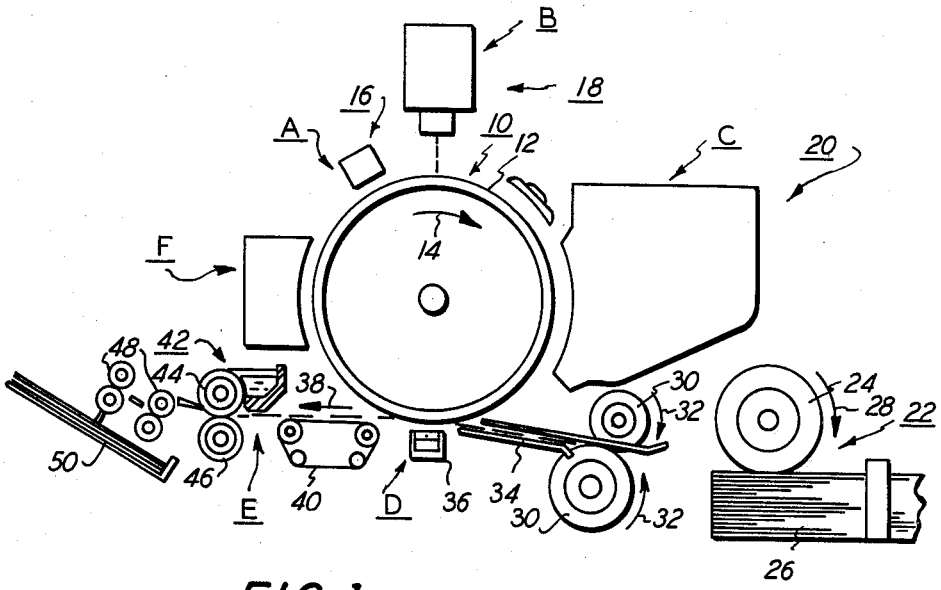
FIG. 1 is a schematic elevational view depicting an electrophotographic printing maching incorporating the elements of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that the development apparatus is equally well suited for use in a wide variety of electrostatographic printing machines, and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a transport layer containing a small molecule dispersed in an organic resinous material and a generation layer having a trigonal selenium dispersed in a resinous material. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device indicated generally by the reference numeral 16 charges photoconductive surface 12 to a relatively high substantially uniform potential.

Next, the charged portion of photoconductive surface 12 is advanced through exposure station B. Exposure station B includes exposure system 18, wherein an original document is positioned face-down upon a transparent platen. The light rays reflected from the original document are transmitted through a lens to form a light image thereof. The light image is projected onto the charged portion of photoconductive surface 12 to selectively dissipate the charge thereon. This records an electrostatic latent image on photoconductive surface 12 which corresponds to the informational areas contained within the original document. Thereafter, drum 10 advances the electrostatic latent image recorded on photoconductive surface 12 to development station C.

At development station C, a magnetic fiber brush development system, indicated generally by the reference numeral 20, advances magnetic particles into contact with the electrostatic latent image. The latent image attracts the particles forming a particle image on photoconductive surface 12 of drum 10. The detailed structure of the development system will described hereinafter with reference to FIGS. 2 and 3.

Drum 10 then advances the particle image to transfer station D. At transfer station D, a sheet of support material is moved into contact with the particle image. The sheet of support material is advanced to transfer station D by a sheet feeding apparatus indicated generally by the reference numeral 22. Preferably, sheet feeding apparatus 22 includes a feed roll 24 contacting the uppermost sheet of a stack of sheets 26. Feed roll 24 rotates in the direction of arrow 28 so as to advance the uppermost sheet into the nip defined by fowarding rollers 30. Forwarding rollers 30 rotate in the direction of arrow 32 to advance the sheet into chute 34. Chute 34 directs the advancing sheet of support material into contact with the photoconductive surface of drum 10 so that the particle image developed thereon contacts the advancing sheet at transfer station D.

Transfer station D includes a corona generating device 36 which sprays ions onto the backside of the sheet. This attracts the particle image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred particle image to the sheet. Preferably, fuser assembly 42 includes a heated fuser roller 44 and a back-up roller 46. The sheet passes between fuser roller 44 and back-up roller 46 with the particle image contacting fuser roller 44. In this manner, the particle image is permanently affixed to the sheet. After fusing, forwarding rollers 48 advance the sheet to catch tray 50 for subsequent removal from the printing machine by the operator.

Invariably, after the sheet of support material is separated from photoconductive surface 12 of drum 10, some residual particles remain adhering thereto. These residual particles are removed from photoconductive surface 12 at cleaning station F. Cleaning station F includes a rotatably mounted fiberous brush in contact with photoconductive surface 12. The particles are cleaned from photoconductive surface 12 by the rotation of the brush in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrophotographic printing machine incorporating the features of the present invention therein.

Figure 2:
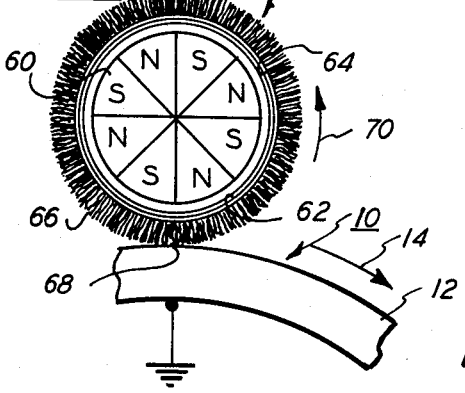
FIG. 2 is a schematic elevational view showing the development system employed in the FIG. 1 printing machine.

Referring now to the specific subject matter of the present invention, the detailed structure of development system 20 is depicted in FIG. 2. As shown therein, development system 20 includes a hopper 52 storing a supply of magnetic particles 54 therein. Particles 54 descend through aperture 56 in hopper 52 onto the surface of developer roller 58. Developer roller 58 includes an elongated cylindrical magnet 60 mounted interiorly of tubular member 62. A tubular sleeve 64 is interfit over tubular member 62. Preferably, tubular sleeve 64 is made from a fabric and has a multiplicity of stainless steel tufts 66 extending in an outwardly direction therefrom. Fabric tube or sleeve 64 is preferably, cemented to tubular member 62. A voltage source (not shown) electrically biases sleeve 64 to a suitable magnitude and polarity to effect development of the latent image with the magnetic particles. Each tuft 66 on sleeve 64 includes a multiplicity of fibers. Tufts 66 contact photoconductive surface 12 of drum 10 in development zone 68. Thus, as the particles 54 are being deposited on the latent image recorded on photoconductive surface 12, tufts 66 are in contact therewith. Tufts 66 extend about the entire circumferential surface of tubular member 62. Preferably, each fiber of tuft 66 is made from stainless steel. Alternatively, each fiber may be made from steel or nickel. Tubular member 62 is made from a non-magnetic material, such as aluminum. Magnet 60 is, preferably, made from a a barium ferrite having a magnetic field impressed thereon.

With continued reference to FIG. 2, magnetic member 60 rotates in the direction of arrow 70 with tubular member 62 being substantially stationary. Alternatively, tubular member 62 may rotate with magnet 60 also rotating or remaining stationary. As magnet 60 rotates, particles 54 are transported over and around tufts 66. In this manner, the magnetic particles are advanced into development zone 68 where they are attracted to the latent image recorded on photoconductive surface 12.

Figure 3:
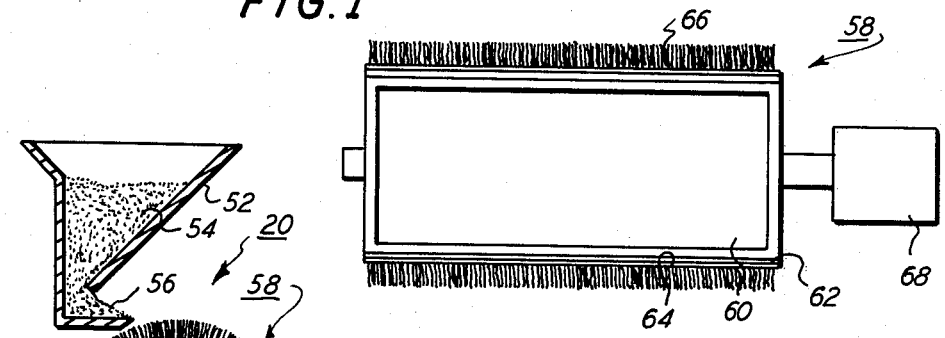
FIG. 3 is a schematic elevational view illustrating the developer roller utilized in the FIG. 2 development system.

Turning now to FIG. 3, developer roller 58 is shown thereat in greater detail. As depicted, nonmagnetic tubular member 62 has a fabric sleeve 64 disposed thereover. Fabric sleeve 64 includes a multiplicity of tufts 66 extending outwardly therefrom. Each tuft 66 includes a multiplicity of stainless steel fibers. Magnetic member 60 is mounted rotatably within stationary tubular member 62. A constant speed drive motor 70 rotates magnet 60. Alternatively, motor 70 may be coupled through suitable gears to magnet 60 and tube 62 such that magnet 60 rotates at a greater angular velocity than tube 62. Still another arrangement is wherein motor 70 rotates tube 62 with magnet 60 being stationary.

With continued reference to FIGS. 2 and 3, each tuft 66 includes a mulitiplicity of stainless steel fibers. Each group of fibers in tuft 66 pass through fabric 64 in a W-shaped configuration. An alternate method of weaving tuft 66 in fabric 64 is wherein each fiber of each tuft 66 passes through fabric 64 in a V or U-shaped configuration.

By way of example, the fabric is preferably made from cotton having a conductive coating of black latex heavily loaded with carbon thereon. Preferably, each tuft has from about 500 to about 1500 fibers therein. Each fiber ranges from about 0.005 to about 0.015 millimeters in thickness. It is preferred that there be from about 8 to about 28 tufts per square centimeter of fabric. The distance between each adjacent tuft preferably ranges from about 0.2 cm to about 0.25 cm. Preferably each stainless steel fiber has similar magnetic properties.

In recapitulation, it is clear that the improved development system of the present invention utilizes a developer roller having a multiplicity of magnetic fibers extending in an outwardly direction therefrom. As the particles are deposited on the photoconductive surface in image configuration, the fibers contact the latent image. This insures that the particle image formed is substantially uniform with substantially no particles being deleted therefrom.

It is, therefore, evident that there has been provided in accordance with the present invention an apparatus for developing an electrostatic latent image recorded on a photoconductive surface that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image with magnetic particles, including:

an elongated tubular member having a multiplicity of magnetic fibers extending outwardly therefrom with the free end regions of at least a portion of said fibers being positioned closely adjacent to the latent image;

an elongated magnetic member disposed interiorly of said tubular member for generating a magnetic field to attract the particles to said tubular member; and means for producing relative movement between said tubular member and said magnetic member to move the particles attracted to said tubular member into contact with the latent image so that the particles being deposited on the latent image form a substantially uniform particle image.

2. An apparatus as recited in claim 1, wherein said fibers are grouped together to form a multiplicity of spaced tufts with each of said tufts having a multiplicity of said fibers.

3. An apparatus as recited in claim 2, further including a fabric secured to said tubular member and having said tufts woven therethrough.

4. An apparatus as recited in claim 3, wherein said fabric includes a conductive coating.

5. An apparatus as recited in claim 4, wherein each of said tufts include from about 500 to about 1500 of said fibers.

6. An apparatus as recited in claim 4, wherein said fabric includes from about 8 to about 28 tufts per square cm.

7. An apparatus as recited in claim 4, wherein each of said fibers range in thickness from about 0.005 to about 0.015 millimeters.

8. An apparatus as recited in claim 2, wherein said tufts are disposed on the circumferential surface of said tubular member.

9. An apparatus as recited in claim 8, wherein said producing means includes means for rotating said magnetic member relative to said tubular member.

10. An apparatus as recited in claim 2, wherein said fibers have substantially similar magnetic properties.

11. An apparatus as recited in claim 2, wherein said fibers are made preferably from stainless steel.

12. An electrophotographic printing machine of the type in which an electrostatic latent image recorded on a photoconductive member is developed with magnetic particles, wherein the improvement includes;

an elongated tubular member having a multiplicity of magnetic fibers extending outwardly therefrom with the free end regions of at least a portion of said fibers being positioned closely adjacent to the latent image;

an elongated magnetic member disposed interiorly of said tubular member for generating a magnetic field to attract the particles to said tubular member; and means for producing relative movement between said tubular member and said magnetic member to move the particles attracted to said tubular member into contact with the latent image so that the particles being deposited on the latent image form a substantially uniform particle image.

13. A printing machine as recited in claim 12, wherein said fibers are grouped together to form a multiplicity of spaced tufts with each of said tufts having a multiplicity of said fibers.

14. A printing machine as recited in claim 13, further including a fabric secured to said tubular member and having said tufts woven therethrough.

15. A printing machine as recited in claim 14, wherein said fabric includes a conductive coating.

16. A printing machine as recited in claim 14, wherein each of said tufts include from about 500 to about 1500 of said fibers.

17. A printing machine as recited in claim 14, wherein said fabric includes from about 8 to about 28 tufts per square cm.

18. A printing machine as recited in claim 14, wherein each of said fibers range in thickness from about 0.005 to about 0.015 millimeters.

19. A printing machine as recited in claim 13, wherein said fibers are disposed on the circumferential surface of said tubular member.

20. A printing machine as recited in claim 13, wherein said producing means includes means for rotating said magnetic member relative to said tubular member.

21. A printing machine as recited in claim 13, wherein said fibers have substantially similar magnetic properties.

22. A printing machine as recited in claim 21, wherein said fibers are made preferably from stainless steel.

* * * * *